United States Patent [19]

Ottemann et al.

[11] Patent Number: 4,807,852

[45] Date of Patent: Feb. 28, 1989

[54] MULTI-PEDESTAL WINCH SYSTEM

[75] Inventors: William C. Ottemann; James E. Plagenhoef, both San Carlos, Calif.

[73] Assignee: Barient, Inc., Fremont, Calif.

[21] Appl. No.: 586,112

[22] Filed: Mar. 5, 1984

[51] Int. Cl.[4] ..... B66D 1/14; B66D 1/26

[52] U.S. Cl. ..... 254/290; 74/483 PB; 74/502; 254/301

[58] Field of Search ..... 254/243, 290, 291, 292, 254/299, 301, 317, 340, 346, 348, 365, 293, 344, 371, 295, 219; 200/5 E, 50 C; 74/483 PB, 10.27, 501 R, 502

[56] References Cited

U.S. PATENT DOCUMENTS

| | | | |
|---|---|---|---|
| 1,704,582 | 3/1929 | Stephenson | 200/5 E X |
| 2,280,652 | 4/1942 | Lamond | 254/292 X |
| 2,933,948 | 4/1960 | Thompson | 74/10.27 X |
| 3,942,762 | 3/1976 | Reymond | 254/344 |
| 4,297,540 | 10/1981 | Tsutsui et al. | 200/5 E X |
| 4,350,109 | 9/1982 | Tattersall | 254/299 X |

FOREIGN PATENT DOCUMENTS

| | | | |
|---|---|---|---|
| 264465 | 10/1964 | Australia | 254/342 |
| 2518753 | 4/1976 | Fed. Rep. of Germany | 254/290 |

*Primary Examiner*—Joseph J. Hail, III.

*Attorney, Agent, or Firm*—Limbach, Limbach & Sutton

[57] ABSTRACT

Multi-pedestal winch system with disconnect automatic reconnect.

4 Claims, 3 Drawing Sheets

MULTI-PEDESTAL WINCH SYSTEM

BACKGROUND OF INVENTION

Multi-pedestal winch systems are associated with large racing yachts, such as a 12 meter yacht raced in America Cup competition. Customarily, these multi-pedestal systems include two pedestal supported cranks which are operable by two sets of winch grinders. The two cranks may be supported on two separate pedestals, or in some situations the two cranks are supported in the spaces between three pedestals. The cranks are operated to rotate output shafts which are connected to winch drum assemblies for pulling in the headsail sheets of the boat. Generally, the two pedestal supported cranks are connected through devices known as disconnects to the port and starboard main winch drum assemblies, where winch drum assemblies may be driven by two or one or none of the pedestal suported cranks. This is accomplished by providing three shaft disconnects, one between the port side winch drum assembly and port side pedestal, a second between the port and starboard pedestal, and a third between the starboard pedestal and starboard winch drum assembly. The disconnects may be provided outboard of the pedestal, or the disconnect may be incorporated into the pedestal housing assembly.

In the normal operations of these multiple pedestal winches, it often occurs that the winch grinders on the port side crank, for instance, may decide that they are needed with the starboard side grinders to help grind the starboard side winch drum assembly. At that time, it is necessary for the port side grinders to operate their disconnect to disconnect from the port side winch drum assembly and then operate the center disconnect to connect the port side crank to the starboard side crank. At the time that this reconnection operation occurs, all members of the crew are normally in an operating mode where almost instantaneous action is desired, and the two step connection operation involving disconnection with the port side winch and connection to the starboard pedestal is more time consuming than is desirable.

SUMMARY OF INVENTION

In accordance with this invention we have provided a single step connection-disconnection mechanism by which the above described disconnection from a winch drum assembly and reconnection to the opposite crank assembly can be performed in a single operation.

The structure for performing this preferably takes the form of a connection box operating three coaxially cable operators which may be connected to the standard inputs of the winch disconnect clutches. Additionally, the mechanism preferably takes the form of a box having three push buttons for disconnecting each of the three standard disconnects separately and in which the operation of any push button for one disconnect automatically reconnects the other two disconnects. With this operating box mounted on the floor of the yacht cockpit between the two pedestal supported cranks, winch operators on either of the pedestal supported cranks can instantly operate the disconnects with a single stroke to disconnect his pedestal from one side and reconnect it to the other. Thus, a winch operator may press his output disconnection to disconnect his crank from the adjacent winch drum assembly and connect to the other pedestal or he can in a single stroke press the operating button for the center disconnect to disconnect himself from the other pedestal and reconnect himself to the adjacent winch.

DETAILED DESCRIPTION

Figure 1:
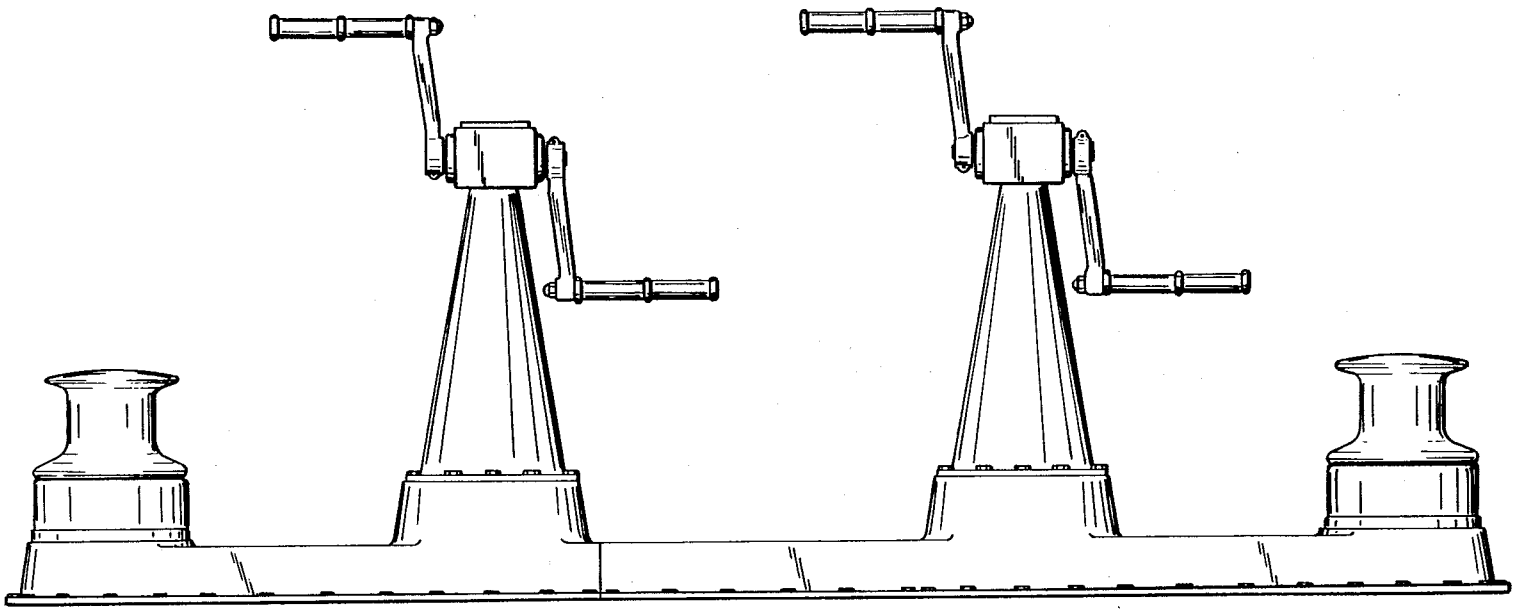
Figure 2:
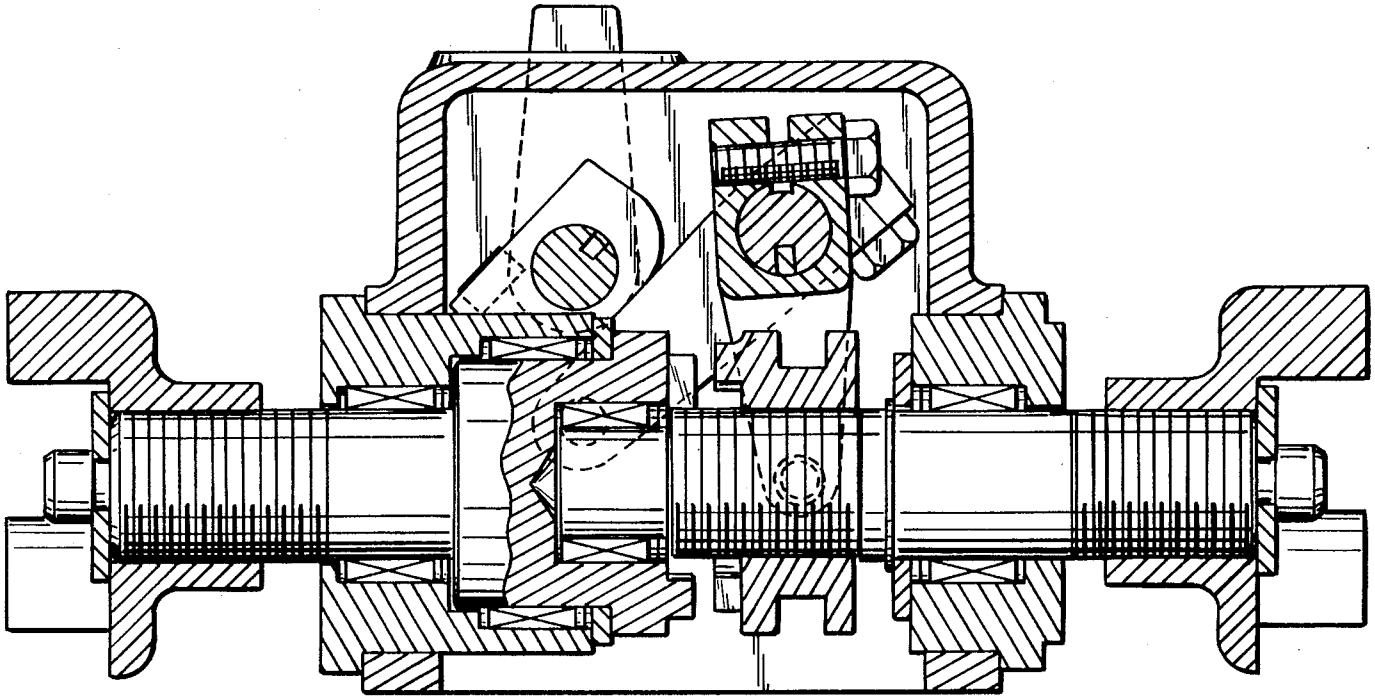
Figure 3:
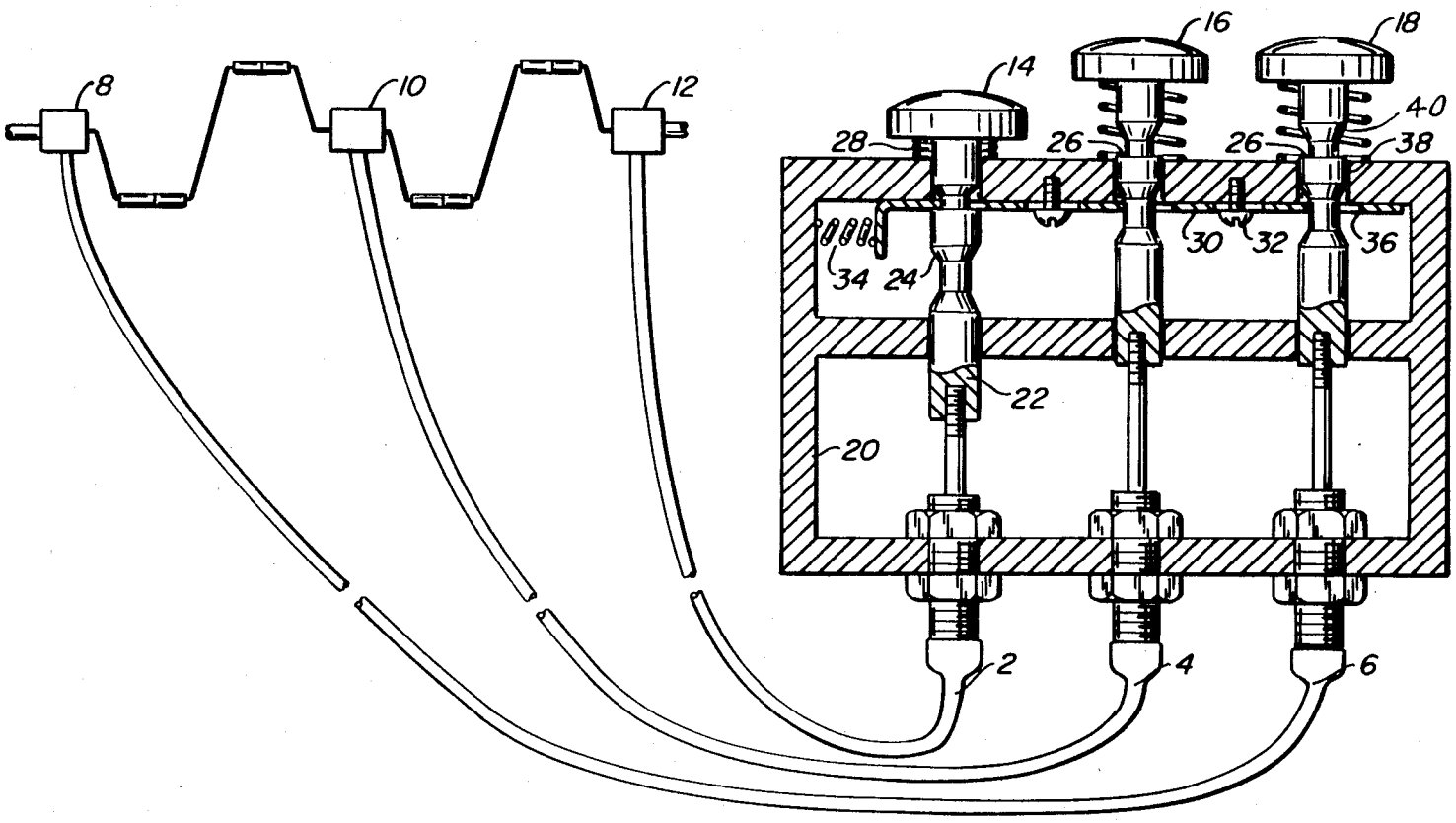

Referring now in detail to the drawings:

FIG. 1 is a side elevational view of a twin pedestal and twin winch drum assemblies with which this invention may be employed, FIG. 2 is a detailed view of one form of disconnect which may be used in the invention in which a yoke is operated to cause connection and disconnection between two dog clutches, and FIG. 3 is a drawing, partially schematic, showing the winch assembly of this invention with the single stroke disconnect mechanism.

In the schematic illustration of FIG. 3, the multi-pedestal winch system is illustrated as the form of system in which two cranks are supported between three pedestals with the disconnects built into the pedestal, whereas, in the form of multi-pedestal winch shown in FIG. 1, two pedestals are supported independently on a base with the disconnects built into the base, one between each pedestal and its adjacent winch drum assembly, and the third between the two pedestals.

Referring in detail to FIG. 3, three coaxial cables 2, 4 and 6 are provided for operating the port, center and starboard disconnects 8, 10 and 12. Each of the cables is operated by a push button 14, 16 or 18 supported in a housing 20. Each of the push buttons has a stem 22 with a release cam surface 24 and a lock cam surface 26, and each push button is provided with a return spring 28 designed to push the push button upwardly to a condition in which the associated cable connects the dog clutches in the disconnect. A plate 30 is supported on the inside of the top of the housing 20 by screws 32 in a condition in which it can slide laterally against a return spring 34. The plate has three apertures 36 which receive the stems of the three push buttons 14, 16 and 18.

The apparatus of FIG. 3 operates in the following way. When a push button, such as button 16, is pushed downwardly, its release cam 24 engages the side of the aperture 36 through which it passes and slides the plate 30 to the left to a condition where it releases all of the latch surfaces 26 on all three of the push buttons 14, 16 and 18. When the push button is depressed further to the point where its latch surface 26 is below the plate 30, the plate 30 is returned to its latch position between spring 34 to hold the push button in the depressed position until it is released again by depressing any one of the push buttons. When the push button is in its fully depressed condition, the drive disconnect to which its cable is attached is disconnected. It will be noted that the disconnect surface 24 is spaced axially from the lock surface 26 by a shoulder 38 so that any one of the three push buttons may be pushed down partially to unlatch all three push buttons and connect all three disconnects at the same time. Additionally each stem is provided with an upper cam release 40 to release the push buttons in case all three push buttons have been pushed at the same time.

We claim:

1. A multi-pedestal winch system comprising:

port and starboard winch drum assemblies, port and starboard pedastal supported cranks, drive means interconnecting the port winch drum assembly and the port pedestal crank with a port disconnect, drive means interconnecting the starboard winch drum assembly and starboard pedestal crank with a starboard disconnect, drive means interconnecting the port and starboard cranks with a center disconnect, and unitary control means for engaging any one of said disconnects while automatically disengaging the other two of said disconnects.

2. The aparatus of claim 1 in which the control means comprises:

a support frame, three push members mounted on the support frame, spring means for returning each of the push members, connector means connecting each of said push members to one of said disconnects to disconnect the disconnect when the push member is pushed and to connect the disconnect when the push member is returned, latch means for latching the push members in their pushed condition and for unlatching all three push members whenever one of the push members is pushed.

3. The apparatus of claim 2 in which said push members are mounted on the deck of a yacht between the two cranks adjacent to the base of the pedestal.

4. The apparatus of claim 2 in which the latch means further includes cam release means for unlatching all three push members, whenever all three push members are in their pushed condition, when one of the push members is pushed.

* * * * *